US012522390B2

(12) United States Patent
Tanner et al.

(10) Patent No.: US 12,522,390 B2
(45) Date of Patent: Jan. 13, 2026

(54) MACHINE FOR GENTLY BANDING SENSITIVE GOODS

(71) Applicant: ATS-Tanner Banding Systems AG, Zug (CH)

(72) Inventors: Alois Tanner, Fahrwangen (CH); Christoph Künzli, Reinach (CH)

(73) Assignee: ATS-TANNER BANDING SYSTEMS AG (CH)

( * ) Notice: Subject to any disclaimer, the term of this patent is extended or adjusted under 35 U.S.C. 154(b) by 302 days.

(21) Appl. No.: 18/032,202

(22) PCT Filed: Aug. 23, 2021

(86) PCT No.: PCT/EP2021/073294
§ 371 (c)(1),
(2) Date: Apr. 17, 2023

(87) PCT Pub. No.: WO2022/078658
PCT Pub. Date: Apr. 21, 2022

(65) Prior Publication Data

US 2023/0391483 A1 Dec. 7, 2023

(30) Foreign Application Priority Data

Oct. 16, 2020 (EP) ..... 20202392

(51) Int. Cl.
*B65B 13/06* (2006.01)
*B65B 13/02* (2006.01)
(Continued)

(52) U.S. Cl.
CPC ..... *B65B 13/06* (2013.01); *B65B 13/02* (2013.01); *B65B 13/04* (2013.01); *B65B 13/22* (2013.01)

(58) Field of Classification Search
CPC ..... B65B 13/02; B65B 13/04; B65B 13/06; B65B 13/18; B65B 13/22
See application file for complete search history.

(56) References Cited

U.S. PATENT DOCUMENTS 4,952,270 A * 8/1990 Sakaki ..... B65B 13/22 100/32
5,146,847 A 9/1992 Lyon et al.
(Continued)

FOREIGN PATENT DOCUMENTS

CH 544694 A 11/1973
EP 0195345 A2 9/1986
(Continued)

OTHER PUBLICATIONS

Search Report for Taiwan Patent Application No. 110133689, dated Dec. 19, 2024. 1 page.

*Primary Examiner* — Jimmy T Nguyen
(74) *Attorney, Agent, or Firm* — Lerner David LLP

(57) ABSTRACT

A banding machine includes a band guide, a band drive, a rotary encoder and a controller. The band guide includes a distance sensor. With the distance sensor, distances to a packaged good lying within the band guide can be determined. With the band drive, a band can be inserted into the band guide and retracted. The rotary encoder can be used to detect a retracted length of the band or the difference in length, (the difference between the inserted length and the retracted length of the band). The controller is designed to determine a desired value taking into account the distances determined by the distance sensor and to control the band drive such that, during retraction, the band is retracted at a first retraction speed and, when the retracted length or the difference in length corresponds to the desired value, the band is retracted at a second, lower retraction speed.

20 Claims, 3 Drawing Sheets

(51) Int. Cl.
*B65B 13/04* (2006.01)
*B65B 13/22* (2006.01)

(56) References Cited

U.S. PATENT DOCUMENTS

| | | | | |
|---|---|---|---|---|
| 2003/0121424 | A1 | 7/2003 | Doyle et al. | |
| 2007/0157555 | A1* | 7/2007 | Tanner | B65B 13/22 53/399 |

FOREIGN PATENT DOCUMENTS

| | | | |
|---|---|---|---|
| EP | 0551244 | A1 | 7/1993 |
| EP | 0881149 | A1 | 12/1998 |
| JP | H0699923 | A | 4/1994 |
| JP | H06278710 | A | 10/1994 |
| TW | M387832 | U | 9/2010 |
| WO | 2015135996 | A1 | 9/2015 |

* cited by examiner

MACHINE FOR GENTLY BANDING SENSITIVE GOODS

CROSS REFERENCE TO RELATED APPLICATIONS

This application is a national phase application of International Application No.: PCT/EP2021/073294, filed Aug. 23, 2021, and claims the priority benefit of European patent applications EP20202392.5 filed on Oct. 16, 2021, the content of the aforementioned being incorporated herein by reference.

BACKGROUND OF THE INVENTION

Field of the Invention

The invention relates to a banding machine for banding stacked, soft and/or sensitive packaged goods, wherein the unwound band is guided around the packaged good, pulled to the packaged good in a return path with a target band tension, then bonded or welded and finally cut off. Furthermore, the invention relates to a method for banding, which is carried out by this banding machine.

In banding machines, a band made of paper, plastic or a composite material, for example, is guided as a loop around a packaged good in a band guide that limits its expansion. For this purpose, the band is inserted through an insertion opening in the band guide, for example, with the aid of a band drive, until the beginning of the band is again in the vicinity of the insertion opening of the band guide. In further embodiments, the band is blown into a loop by an air stream or pulled to a loop by a carriage. Also in these embodiments, the band guide typically includes an opening through which the band enters the band guide. This opening is also referred to herein and hereinafter as the insertion opening. At the insertion opening, the beginning of the band, i.e. the free end of the band, is held in place, for example by clamping. This forms an inherently stable or open loop into which the packaged good is placed. To keep the loop open, a laterally retractable strap guide channel or the use of negative pressure can be used, for example. The packaged good can also be inserted before the loop is formed when the band is pushed in or pulled in. Controlled by a sensor or triggered by a hand or foot switch, the loop is released if necessary, i.e., for example, a band guide channel is pulled away or a vacuum is released, and the band clamped at its free end is pulled back through the insertion opening. This process of retraction is referred to as retraction. The retraction of the band can be done by the band drive. During rewind, the band leaves the band guide and wraps itself increasingly tightly around the packaged good until the target band tension is reached. Then the clamped end is bonded or welded to the tightened band and cut off. The result is a band surrounding the packaged good with a specific band tension, the target band tension. Preferably, the target band tension is the force with which the band was tightened immediately before the time of bonding or welding.

DESCRIPTION OF THE RELATED ART

In known banding processes, a target band tension is specified with which the band is pulled around the packaged good. With soft and/or sensitive packaged goods, however, even a low band tension can lead to damage or buckling. For this reason, CH 696 398 A5 teaches how to specify the length of the strap loop and not just the target strap tension.

This solution prevents the packaged good from being compressed by the band, but only if it is exactly equal to or smaller than the pre-programmed masses. If it is smaller than expected, the resulting band loop is too large and can slip off the packaged good.

However, soft packaged goods in particular, such as piles of laundry, often have a significant variation in size. Thus, in some cases, the preselected loop length results in a band that is too loose and slips off, and in other cases, it results in a band that compresses the stack uncontrollably and causes wrinkles in the laundry.

JP H06 278 710 and EP 0 881 149 A1 propose methods for maintaining and shortening cycle times. In both documents, retraction, i.e. the process step in which the band is pulled back over a relevant length, and tensioning, i.e. a process step in which the target band tension is achieved, are carried out as separate work steps with separate drives. JP H06 278 710 teaches to take into account the size of the packaged good in the speed of the tension roller responsible for tensioning, and to do so in such a way that the time required for tensioning always remains the same. EP 0 881 149 A1 teaches how to shorten the time allowed for retraction, if necessary, depending on the measured height of the object, and to proceed more quickly to the tensioning operation than has been the practice up to now.

Neither JP H06 278 710 nor EP 0 881 149 A1 deal with particularly soft or sensitive packaged goods: EP 0 881 149 A1 even suggests surrounding compressible goods with a particularly high band tension, i.e. using precisely the wrapping for compression.

The separation of retraction and tensioning disclosed in JP H06 278 710 and EP 0 881 149 A1 has the consequence that the lowest possible target band tension is fixed by the retraction: In the known methods, tensioning does not begin until the retraction is complete. The force applied during retraction is therefore the lowest possible target band tension for technical reasons.

In addition, another problem has become apparent in practice: The return, i.e. the retraction of the band, takes place as quickly as possible to enable short cycle times. Rollers and/or other moving parts of the band drive therefore have a high kinetic energy during retraction, which can hardly be released abruptly. If the band drive is therefore only stopped at the moment when the target band tension is detected, the inertia of the band drive means that it still runs out a little, causing the band to strike the packaged good and damage or compression of the packaged good can occur even with low target band tensions.

BRIEF SUMMARY OF THE INVENTION

It is therefore the object of the invention to provide a banding machine belonging to the technical field mentioned at the beginning, with which sensitive packaged goods can be banded quickly without compressing or damaging them to an undesirable extent.

The solution of the object is defined by the features of claim 1. According to the invention, the banding machine comprises a band guide, a band drive, a rotary encoder and a controller. The band guide is provided with at least one distance sensor. With the aid of at least one measured value of the at least one distance sensor, a wrapping circumference can be estimated. In particular, the distance to a packaged good lying within the band guide can be determined from the measured value. A band can be retracted with the aid of the band drive. In a preferred embodiment, the band can also be inserted into the band guide with the aid of the band drive.

The rotary encoder can be used to detect a retracted length of the band or the differential length. The differential length is the difference between an inserted length and the retracted length of the band.

The controller of the banding machine according to the invention is designed to determine a desired value taking into account the at least one measured value of the at least one distance sensor.

In addition, the controller is designed to control the band drive in such a way that the band is first retracted at a first retraction speed during retraction. As soon as the retracted length or the difference in length corresponds to the desired value, the band is retracted at a second retraction speed which is lower than the first retraction speed. The controller is also designed for this purpose.

By recording the measured values of the distance sensors, the circumference of the packaged good relevant for banding can be estimated. The circumference of the packaged good relevant for banding is referred to as the wrapping circumference. Since a band will follow the convex circumference and, in particular, will not penetrate into concave portions of the circumference of the packaged good, the wrapping circumference of the packaged good is preferably the convex circumference of the packaged good in the area where the band is to wrap around the packaged good. The wrapping circumference is therefore preferably the convex circumference of the packaged good in the cutting plane defined by the band guide.

From the estimated wrapping circumference of the packaged good, it is possible to estimate how much band must be retracted before the band comes close to the packaged good during retraction. By running the rewind slower when the band is close to the packaged good than at a greater distance, the band is prevented from striking the packaged good at high speed or being pulled past it quickly with relevant contact pressure. This protects the packaged good and the band. The slower speed also allows precise achievement of low target band tensions. Since a certain amount of time is available for the band drive to decelerate, the demands on the braking device are reduced, making the banding machine more reliable, requiring less maintenance, and lighter. At the same time, the use of the higher first rewind speed, allows short cycle times, as long band sections are retracted quickly, especially with small packaged goods. Since the method is preferably controlled by the effective retracted length or the differential length, it is robust to variations in the efficiency of acceleration of the band and can thus be used without adaptation to a specific band.

Preferably, a band drive roller drives the band and thus constitutes a band drive. Particularly preferably, the band drive is realized by two band drive rollers which grip the band between them in a force-locking manner. However, the band drive can also be designed differently, for example in the form of a conveyor belt on which the band rests over a certain length.

The rotary encoder is a measuring device which determines the length of the inserted and retracted band or the differential length. Preferably, the rotary encoder is realized by a rotary encoder roller which is driven by the movement of the band. In addition to a rotary encoder roller that travels along the band, a rotary encoder can also be implemented optically in particular: For example, uniformly arranged print marks on the band can be detected and counted. The rotary encoder can comprise several spatially distributed components, and parts of the controller can also be part of the rotary encoder at the same time: for example, the rotary encoder roller can generate simple pulses that are received and processed by the controller, or the rotary encoder roller can be designed to be passive, but its movement can be detected by a sensor arrangement, and this sensor arrangement forwards its measured values to the controller. There can also be an intermediate evaluation and/or transmission unit, which amplifies pulses or sensor signals, and preferably evaluates them partially or completely and transmits the result to the controller, and which accordingly also represents part of the encoder.

Preferably, the band guide is curved. On the one hand, this provides more options for mounting the distance sensor and also allows the use of particularly thin bands, since the insertion can be better controlled. In other embodiments, however, band guide comprises only two horns, which limit the resulting band loop laterally but not upwardly. In such cases, the beginning of the band can already be fixed before insertion and the loop is opened by insertion alone.

Preferably, in addition to the retracted length of the band, the rotary encoder can also detect the inserted length of the band. Preferably, in addition to the current difference length, the rotary encoder can also detect the difference length immediately before the start of the retraction. Preferably, these variables are included in the determination of the desired value. By detecting the inserted length of the band or the difference length before the start of the return run, the length of the band in the band guide before the start of the return run is known. This is referred to in the following as the effective inserted band length, Ub.

In a preferred embodiment, the banding machine comprises at least two distance sensors, one of which can determine the distance to the packaged good in a first dimension, preferably in the horizontal direction, and one of which can determine the distance to the packaged good in a second dimension, preferably in the vertical direction.

The first and second dimensions are perpendicular to each other and span the band guide plane.

In another embodiment, the banding machine comprises a distance sensor from whose data the extent of the packaged good in the first dimension as well as in the second dimension is estimated.

The distance sensor(s) allow(s) to estimate the wrapping circumference:

Since the aim of the invention is to protect the packaged good, the wrapping circumference is preferably overestimated. A simple and quick way to obtain a suitable estimate of the wrapping circumference is to approximate the packaged good cross-section by a rectangle surrounding the packaged good cross-section and to use the circumference of this rectangle as an estimate of the wrapping circumference. The side lengths of this approximating rectangle result from the difference of the, generally known, extension of the measuring area and the measured distances to the packaged good. The extension of the measuring range is limited by the distance sensor and, if necessary, guide elements. Such guide elements can be, for example, a conveying surface on which the packaged good lies, or a side wall of the band guide against which the packaged good rests. If the packaged good is guided on two sides, two simple distance sensors are sufficient for circumference estimation.

A simple distance sensor is understood here to be a distance sensor that essentially provides a measured value and, in particular, does not provide any data with spatial resolution. The processing of such measured values is correspondingly simple and fast.

However, it is also possible for a single distance sensor to supply all the necessary data:

Thus, three guide elements can limit the packaged good at the same time and a single simple distance sensor provides information on the remaining, unknown distance. The use of a single simple distance sensor in conjunction with guide elements allows even simpler processing of the measured value.

The distance sensor may also be a complex distance sensor. A complex distance sensor provides more than one measured value and can thus, for example, provide image and distance information or multiple distance information or distance and angle information.

Complex and simple distance sensors are distance sensors.

A distance sensor can also create a height profile over the entire possible width of the packaged good. In such a height profile, the width of the packaged good can be determined as the difference between those points at which the height, in each case starting from the edges of the measuring area, is not equal to the height of the conveying surface, for example the conveyor table, for the first time. The use of a distance sensor that determines spatially resolved distances combines the advantages of minimizing the number of sensors required with great flexibility with regard to the packaged goods that can be banded.

A distance sensor can also detect the smallest distance and the limit observation angles at which the boundaries of the packaged good appear and estimate the distances from this. Similar to the determination of the height profile, a great flexibility with regard to the packaged goods that can be banded can thus be achieved with only one sensor and, in addition, the requirements for the sensor are comparatively low. The limit observation angles can be read off from a normal photograph. For this purpose, the band guide and the guide surface are preferably provided with markings or an angle scale. The smallest distance can be estimated particularly easily from a height profile or by measuring the running time of sensors with a hemispherical or semicircular field of view.

In order to determine the distances required for the desired value determination from the three variables, small and large limit observation angle, as well as the smallest distance, it can be assumed, for example, that the cross-section of the packaged good is rectangular.

If the sensor is now positioned above the packaged good, the measured smallest distance is the distance in the second dimension, in this example the vertical distance. The extent of the packaged good in the first dimension, in this case horizontal, follows from the limit observation angles. The distance in the first dimension, here the horizontal distance, corresponds to the difference of the extent of the measuring area in the first dimension, here the width of the band guide, and the extent of the packaged good in the first dimension, which is here the horizontal extent of the packaged good.

If, on the other hand, the sensor is located in a corner, the measured smallest distance is the distance to a corner of the assumed rectangle. Thus, the corner of the searched rectangle must lie on a circle with the measured distance as the radius around the distance sensor. In addition, the rectangle being searched for is constrained by the observed limit observation angles. Since the location of the distance sensor relative to the conveying surface is known, the rectangle being searched for can now be uniquely determined if it is assumed to lie on the conveying surface. If the rectangle is now known, the distances required for desired value determination can be determined as the difference between the rectangle and the band guide.

The estimation of the wrapping circumference can either be done explicitly in the controller or implicitly in the determination of the desired value.

If the desired value in the banding machine according to the invention is compared with the retracted length, the desired value preferably corresponds to twice the sum of the distances to the packaged good minus a buffer length.

If the desired value in the banding machine according to the invention is compared with the difference length, the desired value preferably corresponds to the sum of twice the distances of the distance sensors or the guide elements from each other and an overlap length minus twice the sum of the distances to the packaged good and minus a buffer length.

Guide elements are surfaces that guide the packaged good and thus surfaces that the packaged good touches during banding.

These embodiments are based on the following considerations:

The wrapping circumference of the packaged good is estimated from the determined distances by determining the circumference of the rectangle enveloping the cross-section of the packaged good. The side lengths of this rectangle are the distances of the distance sensors or guide elements from each other in two dimensions perpendicular to each other minus the distances between the distance sensors or guide elements and the packaged good measured or otherwise known in these dimensions respectively.

Since two mutually perpendicular dimensions are taken into account, there are a total of four possible distances: In each of the two dimensions, starting from a distance sensor or a guide element, the distance to the packaged good can be determined in the direction of the second distance sensor or the second guide element measuring in this dimension.

Each guide element and each distance sensor defines its zero plane: The zero plane of a guide element is perpendicular to the normal of the guide element and the guide element touches its zero plane. The zero plane of a distance sensor has as normal the measuring direction or the symmetry axis of the field of view of the distance sensor. The distance 0 from a distance sensor lies in its zero plane.

In the present case, preferably two zero planes are parallel to each other in each case. Preferably, two zero planes each are perpendicular to the other two zero planes.

The band guide guides the band in a band guide plane on which preferably all zero planes are perpendicular. The distances are preferably determined parallel to and particularly preferably in the band guide plane.

The distances are preferably the distance between the packaged good and the zero plane. If several distances between the packaged good and one of the zero planes are determined, the smallest of the measured distances is preferably used to estimate the wrapping circumference.

The distance of the distance sensors or guide elements from each other in the first dimension is preferably the distance between the first two parallel zero planes. The distance of the distance sensors or guiding elements from each other in the second dimension is preferably the distance between the second two parallel zero planes. If there are no pairs of parallel zero planes, for example because a distance sensor is mounted in a corner of the band guide and the symmetry axis of its field of view is neither perpendicular nor parallel to each of the zero planes of the guiding elements, the distances of the distance sensors or guiding elements in the first and/or the second dimension are preferably determined by using the distances between zero planes of the guiding elements and those points where the distance sensor or sensors measure zero distance.

The distances of the distance sensors or guide elements from each other in the first and second dimensions are also referred to below as the extent of the measuring range. The first dimension is preferably the horizontal and the second dimension the vertical. The vertical is preferably determined by the direction of the plumb line.

Preferably, the distance sensors and guide elements are arranged on the band guide or calibrated in such a way that the intersection lines of the zero planes and the band guide plane approximate the course of the band guided in the band guide and thus the extension of the band guide corresponds to the extension of the measuring range.

If, for example, a distance sensor is arranged at the height h above the conveying surface on the band guide and a vertical distance to the packaged good v has been measured and the packaged good lies on a conveying surface which is a guide element and has a distance 0 from the packaged good, the height of the approximating rectangle is h–(v+0). If the horizontally measuring distance sensors on the band guide have a distance b from each other and the horizontal distances h1 and h2 to the packaged good have been measured, the width of the approximating rectangle is b–(h1+h2). The extent of the measuring area is b in the first and h in the second dimension, if the first dimension is the horizontal and the second dimension is the vertical.

The circumference of the approximating rectangle is twice the sum of the height and width and thus 2(h+b–(v+0+h1+h2)).

In general, the estimated wrapping circumference is as follows:

$$U_p = 2(h+b) - 2\sum a_i$$

where h and b are the extent of the measuring range in the first and second dimensions, and $a_i$ is the measured or known distance of the packaged good from the distance sensors or guide elements. Four distances are considered: two in each of the two dimensions. In many cases, the extent of the measuring range is determined by the mounting of the distance sensors and, if applicable, the guide elements on the banding machine.

If the packaged good is in contact with a guide element on one or two sides, the corresponding distance $a_i$ is given by this contact and is typically 0. Often guide elements are part of the band guide or are permanently installed with it. In this case, the extension of the measuring range is given and can be stored in the controller.

When using adjustable guide elements, however, the extension of the measuring range can be varied. In this case, the extension is preferably determined again and again. This can be done, for example, by measuring the distance by which the guide element concerned is displaced from its known initial position.

If there is a distance sensor opposite a guide element, this can be used to carry out a measurement in the absence of a packaged good and the distance determined in this way can be used as the extent of the measuring range in the dimension concerned. Such measurements can be used both for calibrating a banding machine with permanently mounted distance sensors and guide elements and in the method with adjustable guide elements.

In the case of a single distance sensor providing a height profile, the distances parallel to the measuring direction, i.e. in directions parallel to the zero plane of the distance sensor, result from the locations at which the height profile, coming from the outside, first indicates the packaged good. The distance in the measuring direction, i.e. in the direction of the normal of the zero plane, is preferably the smallest distance detected in the height profile. In the case of several equally aligned distance sensors arranged parallel to one another and measuring, the smallest measured distance to the corresponding zero plane is also preferably to be used in each case.

In the banding machine according to the invention, it is the band guide that is provided with the distance sensors. Preferably, the distance sensors are arranged and/or calibrated in such a way that they detect the distance between the guided band and the packaged good. In this case, the length of the guided band just before the return run is largely determined by the height and width of the band guide. The height h and width b of the band guide in this design correspond to the extent of the measuring range. If the band guide were a perfect rectangle and the distance sensors and possible guide elements were arranged exactly where the band lies when it is inserted, the length of the inserted band would be just 2(h+b) plus a possible, usually, small overlap length u.

$$U_{b,th}=2(h+b)+u$$

The fact that the corners of most embodiments are rounded to guide the band during insertion reduces the inserted length of the band or the difference length before the start of the return run somewhat. A difference can also be caused by the distance sensors being mounted on the band guide slightly offset from the position of the band. In the preferred embodiment presented here, these and similar deviations are neglected or compensated for by appropriate calibration of the distance sensors. It is therefore assumed that the effective inserted band length is equal to the theoretical band length:

$$U_b \approx U_{b,th}=2(h+b)+u$$

The overlap length u also remains with the finished banded packaged good. For a perfectly measured packaged good with a rectangular cross-section, the band length required for banding would therefore be $U_p$+u, i.e. the sum of the estimated wrapping circumference and the overlap length. For a differently shaped packaged good, the band length required for banding is usually smaller. The sum of the estimated wrapping circumference and the overlap length therefore represents the estimate of the maximum required band length.

The minimum length of the band to be retracted until contact with the packaged good $R_{K,min}$ is estimated as the difference between the estimated value of the inserted length of the band and the estimated value of the band length needed for banding:

$$R_{K,min} = U_b - (U_p + u) = 2(h+b) + u - \left(2(h+b) + u - 2\sum a_i\right) = 2\sum a_i$$

According to the invention, in order to protect the packaged good, the second retraction speed should be used in the immediate vicinity of the packaged good. The above estimation leads to the result that with an actually rectangular cross-section of the packaged good and an actual length of the band inserted into the band guide of 2(h+b)+u, the band just touches the packaged good at a retracted length of twice the sum of all distances. The second retraction speed should therefore preferably be used before the retracted length is equal to $R_{K,min}$.

The retracted length of the band is also called the return length.

The length of the band over which it is to be retracted at least at the second retraction speed in the present embodiment is called the buffer length P.

Thus, in this embodiment, the second retraction speed is used as soon as the retracted length that has occurred is twice the sum of all distances minus the buffer length. In the embodiment that compares the desired value with the retracted length, the desired value $S_L$ is therefore preferably set to twice the sum of all distances minus the buffer length.

$$S_L = R_{K,min} - P = 2\sum a_i - P$$

Where $a_i$ are the measured, determined or known distances to the packaged good in the first and second dimension and P is the buffer length.

This embodiment has the advantage that no information about the design of the banding machine has to be stored, but only the measured distances and the buffer length are needed. However, this embodiment requires that the extension of the measuring range be set so that it corresponds approximately to the extension of the band guide.

While the return run length increases with time, the difference length decreases with time during the return run.

If the desired value is compared with the difference length, the question is what the circumference of the remaining loop should be at the time when the retraction speed is throttled. Since the second retraction speed is to be used at least for the buffer length, the desired value $S_D$ of the difference length is the estimated value of the maximum required band length, i.e. the sum of the estimated wrapping circumference and the overlap length, plus the buffer length:

$$S_D = U_p + u + P = 2(h+b) + u - \left(2\sum a_i - P\right)$$

Where $a_i$ are the measured, determined, or known distances in the first and second dimensions, P is the buffer length, h and b are the extent of the measurement range in the first and second dimensions, and u is the overlap length.

This design minimizes the estimation errors, since no assumptions have to be made here about the extent of the band guide, and therefore allows the desired value to be set close to the technical limit, thus keeping the processing time particularly short. By technical limit is meant here that difference length at which the second retraction speed must be selected at the latest in order to reliably avoid damage to a packaged good with a rectangular cross-section.

In addition, only the measurements of the distances as well as the extension of the measuring range and the buffer length P are required for the determination of this desired value. The extent of the measuring range, i.e. the values h and b, can also be determined in many cases by the distance sensors, namely by measuring the distances to each other or to guide elements in the absence of packaged good. The extension of the measuring range, or directly the sum 2(h+b)+u, can also be stored in the controller.

In another embodiment, the desired value $S_L$ of the retracted length comprises a correction term that estimates the difference between the effective inserted band length and the theoretical band length $U_{b,th}$.

The difference length before the start of the return run or the inserted length of the band are a measure of the actual circumference of the band guide. In a further embodiment, the desired value of the retracted length therefore uses this measured value of the inserted band length $L_{IN}$ before the start of the return run and is calculated as follows:

$$S_L = 2\sum a_i - P + L_{IN} - U_{b,th} = 2\sum a_i - P + L_{IN} - 2(h+b) - u$$

This embodiment minimizes the estimation error that can arise from the assumption that the extension of the measuring range is equal to the extension of the band guide, and therefore allows the desired value to be set close to the limit observation angles, thus keeping the processing time particularly short. By technical limit is meant here that retraction length at which the second retraction speed must be selected at the latest in order to reliably avoid damage to a packaged good with a rectangular cross-section.

In another embodiment, the overlap length u is neglected and thus assumed to be u=0 when determining the desired value $S_D$ of the difference length or the desired value $S_L$ of the retracted length.

This embodiment has the advantage that the determination and, if necessary, adjustment of the value u for the overlap length can be dispensed with. If the buffer length is selected generously, i.e. so that it is significantly greater than the overlap length u, there is no risk to the packaged good.

In another embodiment, the difference length before the start of the return run, $D_{max}$, is used instead of the machine parameters h, b and u when determining the desired value $S_D$ of the difference length, and is calculated as follows:

$$S_D = D_{max} - \left(2\sum a_i - P\right)$$

This embodiment has the advantage that no information about the dimensions of the banding machine needs to be available to the controller: $D_{max}$ and $a_i$ are measured values and P is the buffer length desired by the user.

In one embodiment of a banding machine, the machine comprises at least two distance sensors. The distance sensors realize a first and a second observation point at a known distance from each other. One of these distance sensors can determine a small and a large limit observation angles from a first observation point. The other of said distance sensors can determine a small and a large limit observation angles from a second observation point.

Limit observation angles are those angles at which the boundaries of the packaged good appear to the respective distance sensor. A simple way to determine them is to determine the section of an image that is obscured by the packaged good. If the field of view of the camera is known and the properties of its optics, the locations on the image can be assigned to observation angles. In order to simplify the determination and/or to be able to calibrate the camera, the band guide and guiding elements, in particular the conveying surface, are preferably provided with markings which are particularly easy to recognize on the images of the camera. In further embodiments, limit observation angles can also be detected with light barrier systems or laser scanners.

The distance sensors are mounted in such a way that the section of the packaged good within the band guide is completely within their field of view. Thus, each of the sensors detects two limit observation angles. The angles are measured from any known reference in the band guide plane. A possible reference is the parallel to the conveyor surface in the band guide plane or the normal to the conveyor surface. Since the angles of both limit observation angles of an observation point are preferably measured in the same direction starting from the reference, one of the limit observation angles is larger than the other and accordingly represents the large limit observation angle of the corresponding observation point.

In one embodiment of a banding machine whose distance sensors determine limit observation angles, the estimated wrapping circumference is estimated on the circumference of the polygon whose comer points result from the respective first two intersections, counted from the respective observation point, of the following straight lines in the band guide plane: A first straight line passes through the first observation point and includes the small limit observation angle of the first observation point.

A second straight line passes through the first observation point and includes the large limit observation angles of the first observation point.

A third straight line passes through the second observation point and includes the small limit observation angles of the second observation point.

A fourth straight line passes through the second observation point and includes the large limit observation angles of the second observation point.

Preferably, a fifth straight line is considered, which extends along the conveying surface, i.e. lies on the conveying surface.

The comer points of the polygon are intersections of these straight lines. Counted from the respective observation points, only the first two intersection points with participation of the first to the fourth straight line outside the observation points are taken into account.

If the desired value is compared with the retracted length, the desired value then corresponds to the circumference of the band guide minus the sum of the estimated wrapping circumference and a buffer length.

If the desired value is compared with the difference length, the desired value then corresponds to the sum of the estimated wrapping circumference, an overlap length and a buffer length.

For the course of the straight line starting from an observation point, the same reference is used as for the determination of the limit observation angles of this observation point.

In this embodiment, the distance sensors are implemented, for example, by two cameras mounted at a known distance from each other on the band guide: Two limit observation angles can be determined from the images from each of the cameras. From each combination of a limit observation angle of the first camera and a limit observation angle of the second camera, as well as the known distance between the first and the second camera, in each case an intersection point is obtained which lies outside the distance sensors, i.e. the cameras themselves. For example, since the first straight line intersects the third straight line first and then the fourth straight line, these two intersection points are valid intersection points. Likewise, the second straight line intersects first the third and then the fourth straight line, which, also starting from the first observation point, are the first two intersection points and are thus used to determine the polygon. Here there are now four valid intersections and thus the polygon is a quadrangle, whose circumference can serve as a rough estimate of the wrapping circumference.

Since this estimate is very rough, the conveying surface can be included in the analysis as a known boundary of the packaged good to refine the estimate of the wrapping circumference.

In this case, if the straight line along the conveying surface is taken into account, there will be more intersections: Starting from the first camera, for example, the first straight line intersects the third, fourth and fifth straight lines, and in this order. Since only the first two intersections are to be considered, the intersections of the first and third straight lines and the first and fourth straight lines are used as comer points of the polygon. Starting from the first camera, the second straight line intersects, for example, the third, fifth and fourth straight lines in this order. Consequently, the intersections of the second and third straight lines and the second and fifth straight lines are used as comer points of the polygon. Starting from the second camera, it follows from similar considerations that, for example, the comer points of the first and third, the second and third, the first and fourth, and the fourth and fifth straight lines are to be used as comer points of the polygon. Three of the intersection points to be considered starting from the first camera are equal to three of the intersection points to be considered starting from the second camera. Thus, in summary, there are five different corner points to be considered in this case and the polygon is correspondingly a pentagon. The wrapping circumference in this case is estimated to be the circumference of this pentagon.

This embodiment has the advantage that known and easily available sensors, namely optical cameras, can be used with a simple evaluation, namely for example comparing the known image of the band guide with an image of the hidden band guide, to obtain the desired estimate in a simple, cheap and robust way.

In one embodiment, the banding machine includes an input interface that allows the user to input information about a band. The desired value calculation preferably takes into account an indication of the mass per length of the band. In particular, the buffer length is increased with increasing mass per length.

The mass of the band determines the kinetic energy and the momentum of the band moving at the first retraction speed. When the retraction speed is reduced, correspondingly less kinetic energy must be dissipated for a lighter band. Thus, in many cases, a lighter band can be braked later than a heavier one. Due to the mass dependence of the buffer length, the cycle time for lighter bands can be further reduced.

In a preferred embodiment of a banding machine, the buffer length is 10 to 20 cm.

It has been shown that for common bands and typical goods to be banded, the desired effect can be reliably achieved with a buffer length in the order of 10-20 cm.

For example, a packaged good with a banding circumference of 70 cm is banded as follows in a banding machine according to the invention, the band guide of which has a circumference of 140 cm: The banding machine estimates the wrapping circumference to be 70 cm on the basis of the measurement of at least one distance sensor, and a buffer length of 10 cm is stored in the controller in this example. The band is inserted at an average speed of 2.8 m/s. The band is then fed into the machine. The belt loop is thus formed within half a second. The direction of action of the band drive is reversed and it now pulls the band back again with an acceleration similar to that during insertion, so that the first retraction speed is also approx. 2.8 m/s. However, this first retraction speed is only used for the first time. However, this first retraction speed is only used for retracting the first 60 cm of the total inserted 140 cm. This desired value of the retracted length is the difference between the circumference of the band guide, in this case 140 cm, and the sum of the estimated wrapping circumference of 70 cm and the buffer length of 10 cm. If, on the other hand, the controller uses the difference length, the retraction speed is throttled from a desired value of 140−60=80 cm. Once the desired value is reached, the second retraction speed of, for example, 0.1 m/s is aimed for. In addition, the force with which the band is moved is reduced to the target band tension of 0.1 N selected here. The buffer length of 10 cm thus allows the band drive to be braked comparatively gently over a time interval of more than 0.05 seconds.

In one embodiment, a banding machine comprises either an input interface and/or at least one detection sensor. The input interface can be used to set a target band tension. The detection sensor can detect a packaged good type, for example based on an identification code. If a detection sensor is used, the banding machine preferably also comprises a memory with a database in which a target band tension is assigned to this packaged good type.

In this way, the target band tension can be adapted to the respective packaged good. The target band tension can be selected higher if a secure holding together of the packaged good by the band is desired and lower if the packaged good deforms easily and this deformation is undesirable. For example, a stack of terry towels can be banded with a higher target band tension than a stack of ironed napkins, where deformation would lead to undesirable wrinkling.

In one embodiment, the detection sensor uses at least one of the distance sensors. The packaged good type is detected based on dimensions of the packaged good and/or reflective properties and/or its appearance.

This embodiment eliminates the need for additional sensors, while still providing the user with the convenience of not having to manually input to change the target band tension when changing the packaged good type. While the dimensions of the packaged good result quasi as a by-product of the distance measurement and are thus easily accessible, the additional detection of the reflective properties may also allow packaged good types of similar size or with a similar height profile to be distinguished from one another. If cameras are used as distance sensors, a packaged good type can also be inferred on the basis of appearance.

If the optical distance sensor is a laser triangulation in which the point at which a laser reflected on the surface impinges on an internal image sensor is observed, the expansion of this point and the intensity of the reflected radiation contain information about the surface structure and its reflectivity in the wavelength range of the measuring laser: Terry towels reflect the laser, for example, more diffusely and less strongly than ironed napkins, so that these two packaged good types can be distinguished on the basis of their reflectivity properties, for example. Even if an interferometric measurement principle or a time-of-flight measurement is used, the intensity of the reflected light can be detected and used to identify the packaged good type.

In one embodiment of a banding machine, the second retraction speed is selected as a function of the target band tension. In particular, the lower the target band tension, the lower the second retraction speed is selected.

In particular, the second retraction speed is selected to be greater the more elastic the selected band is.

In order to achieve a low target band tension and without having exceeded it beforehand, the band should be retracted at such a speed that the band tension resulting from the inertia of the band drive is always less than the target band tension. If this condition is fulfilled, the target band tension can be set by controlled retraction with the band drive.

Preferably, the second retraction speed is selected in such a way that the inertia of the band drive results in a band tension just below the target band tension. In this way, banding is particularly fast.

Preferably, the relationship between the band tension achieved by the inertia, the specific band and the retraction speed used is determined by a calibration test. For example, a compressible test specimen can be banded at various retraction speeds using the desired band and it can be determined how much the test specimen was compressed in the process. From this compression, given known properties of the test body, the highest band tension that occurred in the method can be derived. This allows a table to be created in which retraction speed and inertia-induced band tension are recorded. By interpolation of these data, a rule can then be determined with which, for the given banding machine and the given band, the highest usable second retraction speed for a given target band tension can be estimated in each case.

Preferably, the second retraction speed is calculated for a specific band by determining in a first step which band length may still be retracted from the point at which contact with the packaged good is detected in order not to exceed the target band tension. If this length is known and also the braking acceleration that the band drive can and should provide, it can be calculated what the speed is that drops to zero over the specified length with the braking acceleration. In many cases, the band length of the first step will make this calculation dependent on the length of the band. Preferably, therefore, the wrapping circumference is used as an estimate of the length of the band for this calculation. Since this estimate can lead to too high values for the second retraction speeds, the second retraction speed actually used can be deliberately selected to be smaller than the value determined, for example to 75%, 80% or 90% of the estimate.

In a preferred embodiment, the distance sensors are optical sensors. Laser triangulation, the determination of the time of flight of light or interferometry is particularly preferred as the measuring principle of the sensors.

Optical sensors measure the distances without contact and with great precision. The packaged good to be banded is thus not affected.

In addition to laser triangulation, time-of-flight determination and interferometry, light barrier arrays or cameras could also be used for optical distance determination. Laser triangulation, time-of-flight determination and interferometry have the advantage that the sensor data can be easily evaluated and the distance values can therefore be determined quickly and with low computing power.

The preferred optical measuring principles also have the advantage that, in the event of an alleged malfunction, the user can check comparatively easily whether a measuring light is being emitted at all and where it is hitting the packaged good. For lasers in the visible wavelength range, it is usually sufficient to darken the environment. For lasers of other wavelengths, a suitable indicator card can be used to check accordingly. If the band guide is at least partially provided with a corresponding, for example fluorescent, indicator color on the side opposite the distance sensor, the user can intuitively and immediately recognize the field of view and the functioning of the distance sensor. Providing the band guide with fluorescent or otherwise conspicuous indicator color can also simplify the determination of the limit observation angles when using cameras as distance sensors.

In a further embodiment, the distance sensor can detect both an image and distances.

In further embodiments, the distances are detected via radar or echolocation, for example by means of ultrasound.

In a preferred embodiment, the distance sensors detect the distances to the packaged good along sections in the band guide plane or in one or more parallel planes in the immediate vicinity and output the smallest detected distance value to the controller of the banding machine. In this way, errors in the estimation of the wrapping circumference, which can be attributed to a distance sensor measuring the distance at an unsuitable point, for example next to the packaged good, can be avoided.

In a preferred embodiment of a banding machine, the band is pushed into the band guide through an insertion opening. The insertion opening is located below a conveying surface. Two distance sensors are located essentially opposite each other on the band guide and determine the horizontal distance to the packaged good from opposite directions. Another distance sensor is located above the conveying surface on the band guide and determines the vertical distance to the packaged good.

The packaged good is conveyed on the conveying surface. This is therefore a guide element and the distance to the conveying surface is zero. Since the conveying surface serves as a guide element, it is ensured that the packaged good is in contact with the guide element. The remaining three distances are measured by, preferably simple, distance sensors. It is thus sufficient for each of the distance sensors to measure the distance in one direction. The distance sensors can thus be of comparatively simple design and the measurement is carried out quickly.

In another preferred embodiment, the band is pushed into the band guide through an insertion opening. The insertion opening is located next to the conveying surface. A first distance sensor is located on the band guide opposite the insertion opening and determines the horizontal distance to the packaged good. A second distance sensor is located on the band guide above the conveying surface and determines the vertical distance to the packaged good.

This embodiment has the advantage that the comparatively voluminous components of the banding machine located in the vicinity of the insertion opening are arranged next to the band guide. This leaves space below the band guide free and can be used, for example, for a conveyor section for the finished banded packaged good.

The plane in which the insertion opening is located also preferably serves as a guide element in this embodiment. Since the band is inserted through the insertion opening and pulled back again, positioning the packaged good at a distance from this plane would otherwise either cause the resulting banderole to become too large or the target band tension would be selected to be so high that the packaged good would be pulled towards the plane of the insertion opening by the band during the return run.

The embodiment thus comprises two guiding elements: The conveying surface and the plane of the insertion opening. Two of the four possible distances are thus known and the first and second distance sensors can be used to determine the remaining two distances.

This embodiment thus has the advantage of enabling a good and fast estimation of the wrapping circumference even with only a few distance sensors and of banding sensitive packaged goods gently and quickly.

In another preferred embodiment, the band is pushed into the band guide through an insertion opening. The insertion opening is located above a conveying surface. Two distance sensors are located essentially opposite each other on the band guide and determine the horizontal distance to the packaged good from opposite directions. A further distance sensor is located in the plane of the insertion opening and determines the vertical distance to the packaged good. The conveying surface is preferably adjustable in height. Preferably, the controller adjusts the height of the conveying surface as a function of the distance measured by the vertical distance sensor in such a way that the packaged good is in contact with the plane of the insertion opening at the time when the band is retracted.

By adjusting the conveying surface, controlled and, if the plane of the insertion opening is suitably flat, also particularly uniform compression can be achieved during banding with low target band tension. For example, such uniform, two-dimensional compression can remove excess air from a stack of ironed napkins as packaged goods without causing them to buckle. The stack can then be gently banded in the compressed state. Thanks to a low selected target band tension, wrinkles at the outer edges of the stack can be avoided.

Another application example is the banding of compressible products, such as bundles of celery sticks: Here, the conveying surface can be moved or adjusted in such a way that there is a target height between the conveying surface and the level of the insertion opening. Due to its compressibility, the packaged good adapts to this target height. The subsequent gentle banding can be carried out with low target band tension, so that the packaged good is only compressed laterally to the desired, small extent.

In the desired value calculation, a height-adjustable conveying surface can be taken into account as follows: When determining the extent of the measuring range, the conveying surface is detected in its basic position by the vertically measuring distance sensor. The basic position is preferably the lowest position of the conveying surface. The packaged good is then placed on the conveying surface in its basic position and the distance to the packaged good is measured there. This is the distance value which is then used in the desired value calculation. Alternatively, both vertical distances can be assumed to be 0 and the conveying surface can be moved up in a correspondingly reduced extension of the measuring range.

In one embodiment, the distance sensor for determining the vertical distance is dispensed with and instead the conveying surface approaches the plane of the insertion opening until a predetermined resistance opposes this movement. This resistance may just correspond to the target band tension. In this case, the original distance can be determined via the travel distance of the conveying surface.

A method for banding according to the invention comprises the following steps: Distances and/or limit observation angles to a packaged good lying within the band guide are determined, or the wrapping circumference is estimated with the aid of at least one measured value of at least one distance sensor.

In a preferred embodiment, a band is inserted into the band guide.

A desired value is determined, taking into account the determined spacing and/or the limit observation angles or the estimated wrapping circumference.

The band is first retracted at a first retraction speed.

The retracted length of the band or a difference length, i.e. the difference between the inserted and retracted length of the band, is detected.

From the time when the retracted length of the band or the difference length corresponds to the desired value, the band is retracted at a second retraction speed. The second retraction speed is lower than the first retraction speed.

Preferably, the method is carried out on the banding machine according to the invention.

Preferably, the same band drive accelerates and brakes the band during insertion and return run.

In this way, it is achieved in a simple manner that the power transmission for the accelerations can be selected to be the same in all directions of movement. This simplifies the controlling. In addition, a particularly compact design can be achieved.

Preferably, the method also comprises the steps of terminating the return run and connecting the band to itself as soon as a target band tension is reached.

In this way, a gentle banding is achieved that is adapted to the specific packaged good: the band can be tensioned just enough so that it corresponds to the target band tension and, for example, on the one hand does not slip off the packaged good and, on the other hand, the band does not damage or significantly compress the packaged good.

In another embodiment, the return run is terminated and the band is joined to itself as soon as a certain band length has been retracted or as soon as a desired difference length has been reached.

This achieves a consistent band length while preventing the band from hitting the packaged good at high speed and damaging it. In addition, the method is gentle on the banding machine, as the drive can be braked particularly gently.

In another embodiment, the return run is terminated and the band is connected to itself once a target band tension has been reached or a specified band length has been retracted or once a desired difference length has been reached, whichever of these criteria occurs first.

In this way, it can be achieved that the banderole always has a certain minimum length and at the same time the packaged good is protected from excessive band tension. This is useful, for example, with foodstuffs that vary in size but should not be compressed and on whose banderoles ingredient lists are printed, which is why the banderoles must have a minimum length for a given design. Breads are an example of such food.

From the following detailed description and the entirety of the patent claims, further advantageous embodiments and combinations of features of the invention arise.

BRIEF DESCRIPTION OF THE SEVERAL VIEWS OF THE DRAWINGS

Further advantages, features, and details of the various embodiments of this disclosure will become apparent from the ensuring description of a preferred exemplary embodiment and with the aid of the drawings. The features and combinations of features recited below in the description, as well as the features and feature combination shown after that in the drawing description or in the drawings alone, may be used not only in the particular combination received, but also in other combinations on their own, without departing from the scope of the disclosure.

The drawings used to explain the embodiment show.

In principle, the same parts are provided with the same reference signs in the figures.

DETAILED DESCRIPTION OF THE INVENTION

As used throughout the present disclosure, unless specifically stated otherwise, the term "or" encompasses all possible combinations, except where infeasible. For example, the expression "A or B" shall mean A alone, B alone, or A and B together. If it is stated that a component includes "A, B or C", then, unless specifically stated otherwise or infeasible, the component may include A, or B, or C, or A and B, or A and C, or B and C, or A and B and C. Expressions such as "at least one of" do not necessarily modify an entirety of the following list and do not necessarily modify each member of the list, such that at least one of "A, B, and C" should not be understood as including only one of A, only one of B, only one of C, or any combination of A, B, and C.

Figure 1:
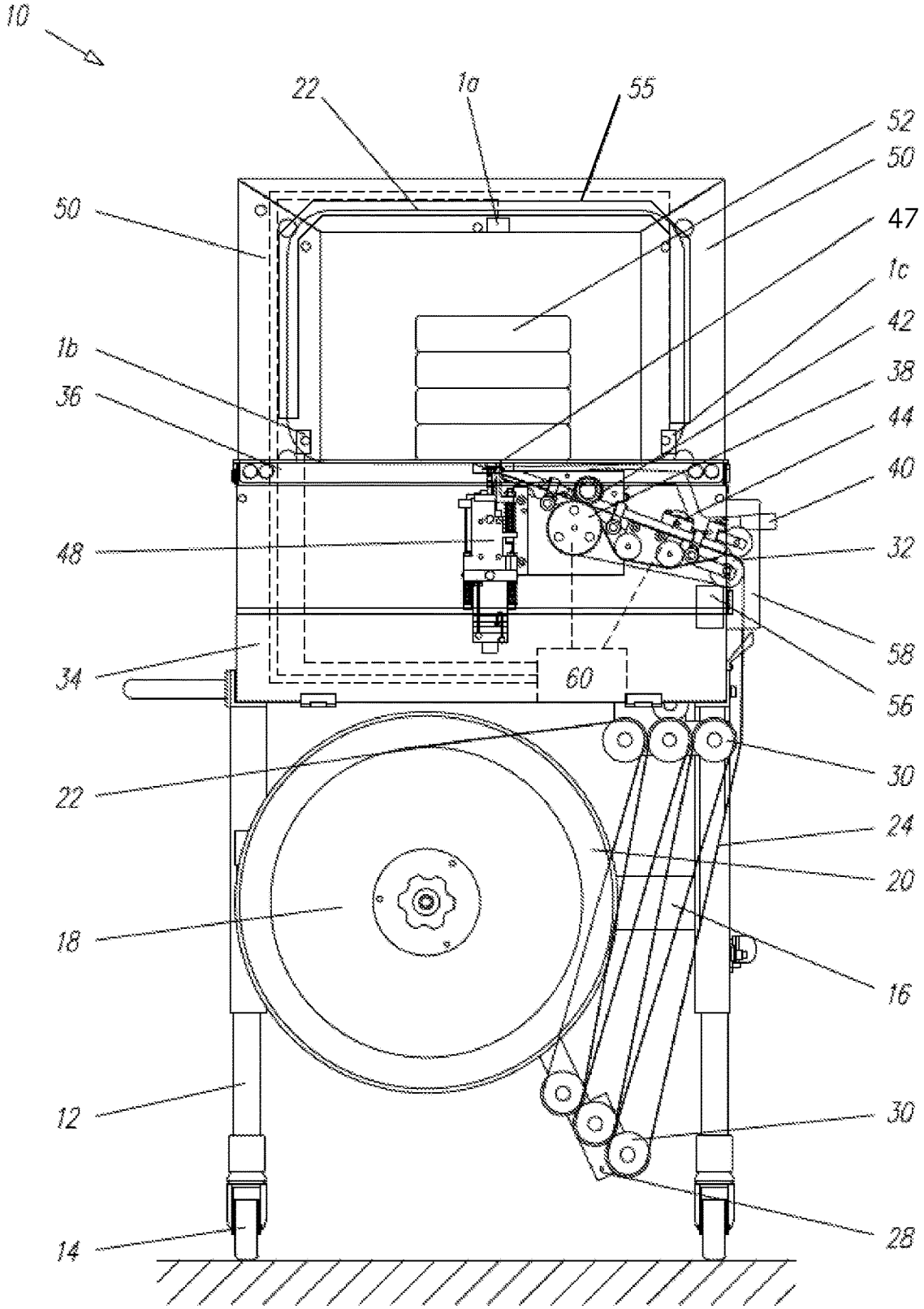
FIG. 1 a view of a banding machine with a rotary encoder roller.

FIG. 1 shows a banding machine 10 with a height-adjustable chassis 12 on lockable wheels 14. An unwinding disc 18 with a band roll 20 is rotatably mounted on a cross strut 16 of the chassis 12. A band 22 is unwound via a band accumulator 24, which comprises three stationary deflection rollers 26 and three deflection rollers 30 mounted on a tensioned, pivoting lever 28. When loops are formed very quickly than when the band is inserted, the band accumulator 24 serves as a reserve. Likewise, the band accumulator 24 can receive the band 22 that has been retracted during return run.

After the band accumulator 24, the band 22 is drawn into a band channel 32, which is arranged in a machine housing 34 with a table 36. The table 36 represents a conveying surface and a guide element. Further machine elements are arranged in this machine housing 34, in particular a band drive roller 38, a transport roller 42 which presses the band 22 against the band drive roller 38 or allows it to run freely when a lever 40 is in the appropriate position, a rotary encoder roller 44 which travels exactly with the band 22, a welding and cutting unit 48, and a controller 60, in this case a digital controller, which is electrically connected to the drive of the band drive roller 38 and the rotary encoder roller 44. The band is gripped frictionally by the band drive roller 38 and the transport roller 42 and is pushed in and retracted by the movements of the band drive roller 38 and/or the transport roller 42.

Here, the band drive is realized by the band drive roller 38 and the transport roller 42, and the encoder is realized by the encoder roller 44. At the exit of the band channel 32, the insertion opening 37 of the band guide 50 is located. Thus, in this case, the table 36 also realizes the plane of the insertion opening 37.

The band guide 50 in the area of stacked packaged good 52 is presently a curved structure which, together with the table 36, defines a substantially rectangular interior space. The band guide 50 is open to the interior space surrounded by it. In the present case, a laterally open and laterally retractable band guide channel 55 is disposed in the interior of the band guide 50. In an insertion position, the band guide channel 55 prevents the band from leaving the band guide 50 at an undesired time during insertion or the band loop formed.

The band guide 50 carries a total of three simple distance sensors 1*a*, 1*b*, 1*c*, which determine the distance to the respective nearest surface of the packaged good 52. The simple distance sensors 1*a*, 1*b*, 1*c* are arranged in such a way that the measuring direction of the simple distance sensor 1*a* points in the direction of the table 36, while the measuring directions of the simple distance sensors 1*b* and 1*c* both point in the interior and are both at a 90° angle to the measuring direction of the simple distance sensor 1*a*.

The distance sensors 1*a*, 1*b* and 1*c* transmit the measured distances to the digital controller 60, which uses them to determine a desired value.

A switch 56 is arranged under a flap lid 58. This switch 56 can also be designed as a foot switch. Actuation of the switch 56 activates the band drive, which pushes the band 22 at high speed into the band guide 50. In further embodiments, the band drive is activated by a sensor signal after the machine has been started by actuating the switch 56. The sensor signal may, for example, be a signal from one of the distance sensors 1*a*, 1*b*, 1*c* and the activation may be time delayed to allow the user to position the packaged good 52. However, the sensor signal can also be the signal of a packaged good sensor which detects in any way that the packaged good 52 lies in the band guide 50 in a manner suitable for banding.

Before or after forming a loop, the beginning of the band 22 is clamped with the band start clamp 47. At a fixed distance from the insertion, triggered by the switch 56, a foot switch, or by a sensor signal, the band guide channel 55 is first pulled away to the side, thus releasing the band loop, Then the band drive retracts the band 22 and thus around the inserted, stacked packaged good 52, which is referred to as the return run. For this purpose, the band drive roller 38 is rotated in the opposite direction.

The return run initially occurs at a first retraction speed. The encoder roller 44 continuously monitors the retract length, i.e. which length of the band 22 has already been retracted, or the difference length. In the case of the difference length, the encoder roller 44 detects the band movements during insertion with a positive sign and during return run with a negative sign. In each case the band lengths are detected.

The controller 60 compares the value of the encoder, here implemented by the encoder roller 44, with the desired value: if it is detected that the values are the same, the speed of the band drive roller 38 is reduced and in such a way that the band speed ultimately corresponds to the second retraction speed.

Simultaneously with the throttling of the band drive to the second retraction speed, the target band tension is set, for example, at the coupling or at the drive of the band drive roller 38: The drive can thus stop driving the band drive roller 38 when the target band tension is reached. As soon as the encoder roller 44 detects that the band has come to a halt, the controller 60 triggers the action of the welding and cutting unit 48: The band loop is sealed and separated from the remaining band 22. The packaged good 52 is banded and can be removed.

In another embodiment, together with the speed, the angular momentum of the band drive roller 38 is also adjusted so that the tensile force transmitted to the band corresponds to the target band tension.

In another embodiment, the pressure of the transport roller 42 on the band drive roller 38 is reduced such that the band slips between the transport roller 42 and the band drive roller 38 when the target band tension is reached and thus cannot be tensioned more than the target band tension.

Figure 2:
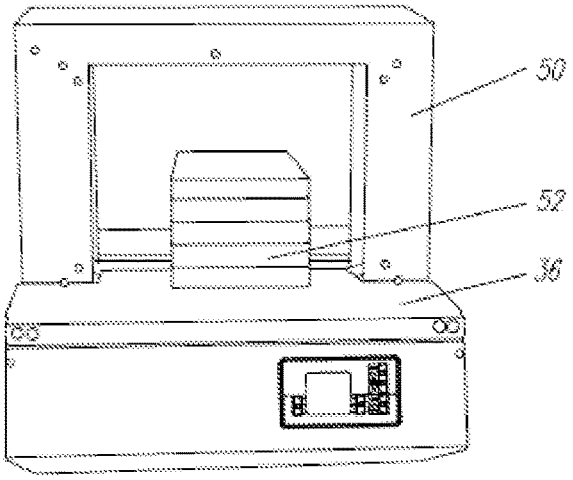
FIG. 2 a view of a banding machine with packaged good on the table, before the beginning of the retraction of the band.
Figure 3:
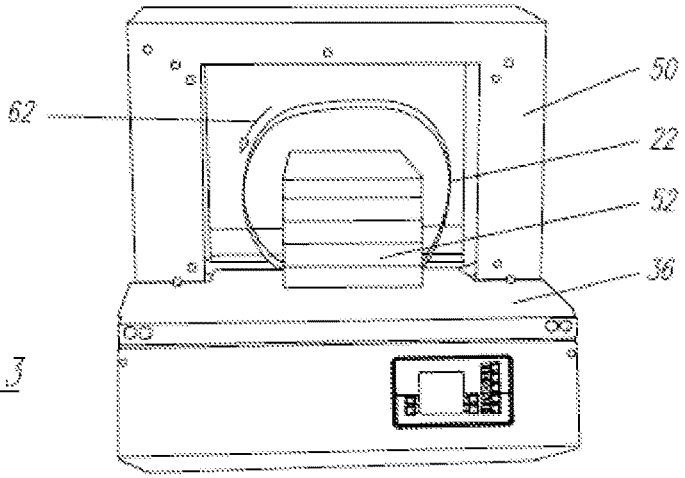
FIG. 3 a view of a banding machine with packaged good on the table, during the return run of the band just before the second retraction speed is used.
Figure 4:
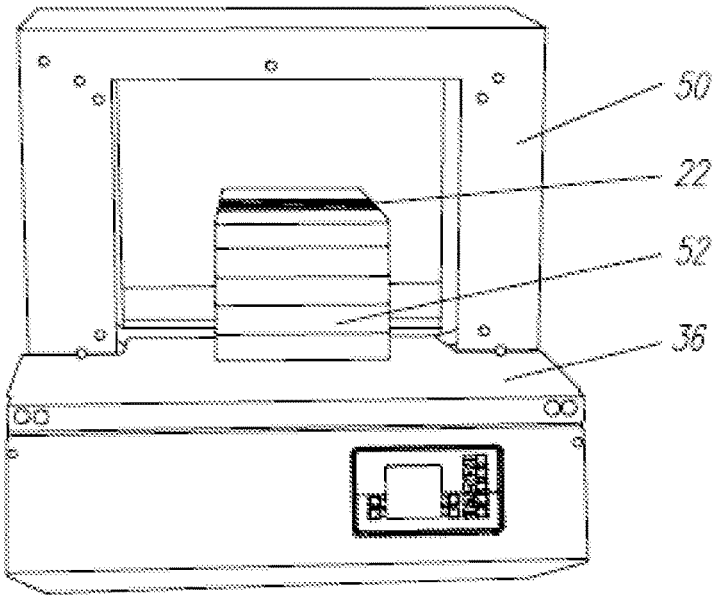
FIG. 4 a view of a banding machine with banded packaged good on the table, just before removal of the packaged good.

FIGS. 2 to 4 illustrate the banding process: FIG. 2 shows the situation before the start of the return run: the band is not visible because it is still in the band guide 50. Packaged good 52 in the space surrounded by band guide 50 on table 36. A sensor or the actuation of a switch or pedal by the user triggers the return run. The band 22 is released, if necessary, and then retracted, initially at an initial retraction speed 62, exiting the band guide 50 and forming an increasingly smaller band loop. As soon as the circumference of the band loop is only slightly larger than the estimated wrapping circumference 53, the retraction speed is reduced to the second retraction speed. The speed at which the band loop is reduced decreases as a result. The band drive can be stopped correspondingly precisely and faster due to the lower speed, so that the packaged good 52 is not compressed after banding has been completed, shown in FIG. 4, and its edges are undamaged. The band 22 nevertheless tightly surrounds the packaged good. After the band loop has been closed and separated from the remaining band by the welding and cutting unit 48, the banded packaged good can be removed.

Figure 5A:
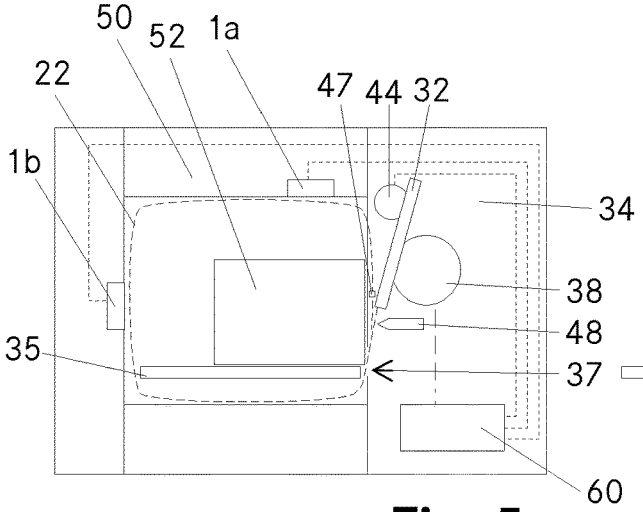
FIG. 5*a* a view in the conveying direction of the packaged good of the curved band guide of a banding machine and packaged good fed on a conveyor belt, the band drive roller and the welding and cutting unit being arranged next to the conveyor belt.

FIG. 5*a* shows a view in the conveying direction of the packaged good 52 of the curved band guide 50 of a banding machine. Packaged good 52 is located on a conveying surface 35, for example a conveyor belt. The band drive roller 38 and the welding and cutting unit 48 are arranged next to the conveying surface 35. The insertion opening 37 is also located laterally next to the conveying surface 35. The plane of the insertion opening 37 is thus not equal to the conveying surface 35 in this example. There are two guide elements: The plane of the insertion opening 37 and the conveying surface 35.

As in the banding machine described in FIG. 1, the band 22 is accelerated in a band channel 32 by a band drive roller 38. The band 22 is pushed through an insertion opening 37 into the band guide 50 until the beginning of the band has reached its end position and is fixed by a band start clamp 47.

The packaged good 52 lies inside the curved band guide 50 on the conveying surface 35. The side wall of the machine housing 34, in which the insertion opening 37 is located, represents a guide element. The side wall of the machine housing 34 realizes the plane of the insertion opening 37. The packaged good 52 lies both on this guide element in the form of the side wall of the machine housing 34 and on the conveying surface 35.

Two distance sensors 1*a, b* are mounted on the curved band guide 50. A horizontally aligned distance sensor 1*b* measures the distance in the direction of the guide element formed by the side wall of the machine housing 34. The vertically aligned distance sensor 1*a* measures the distance in the direction of the conveying surface 35. The distances measured by the two distance sensors 1*a* and 1*b* are transmitted to the controller 60.

A memory of the controller 60 stores the distance of the horizontally aligned distance sensor 1*b* from the guide element formed by the side wall of the machine housing 34, the distance of the vertically aligned distance sensor 1*a* from the conveying surface 35 and the length over which the band 22 overlaps in the finished banderole 23, i.e. the overlap length.

Finally, a buffer length is also stored in the controller 60. The controller 60 determines the desired value from the stored data and the measured distances.

In addition to the band drive roller 38, there is also a rotary encoder roller 44 on the band channel 32. The rotary encoder roller 44 runs with the band 22 and records its revolutions. In the present example, the revolutions are counted positively when the band is inserted and the revolutions are counted negatively during the return run. The count of the encoder roller 44 is thus a measure of the difference length. In this example, the encoder roller 44 is thus also the encoder. The current difference length is transmitted to the controller 60.

Upon actuation of a button not shown, a foot switch, or based on detection of the packaged good 52 by the distance sensors 1*a,b* or by a detection sensor or other sensor, the return run begins: The controller 60 ensures that the band 22 is released, if necessary, and instructs the drive of the band drive roller 38 to rotate it in the opposite direction and in such a way that the band 22 moves at the first retraction speed. During the return run, the controller 60 compares the difference length transmitted by the encoder roller 44 to the desired value. If the difference length equals the desired value, the drive of the band drive roller 38 is instructed to drive the band drive roller 38 such that the band 22 moves at the second retraction speed. In addition, the coupling between the band drive roller 38 and its drive is adjusted so that the band drive roller 38 cannot apply more tensile force to the band than the target band tension: when the band loop has reached the target band tension, the band drive roller 38 and the band 22 come to a stop. The encoder roller 44 no longer changes its counter, and the controller 60 thus detects that the band loop can be closed by welding to form a banderole 23 and should be separated from the rest of the band 22. The welding and cutting unit 48 carries this out. The packaged good 52, now banded, can be removed or conveyed away on the conveying surface 35.

Figure 5B:
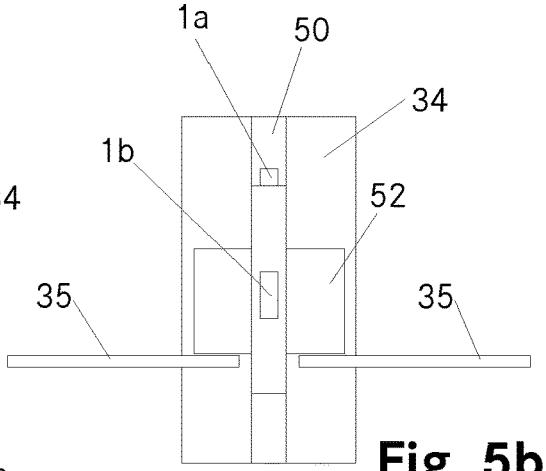
FIG. 5*b* a view perpendicular to conveying direction of the packaged good of the banding machine of FIG. 5*a;*

FIG. 5*b* shows a view perpendicular to the conveying direction of the packaged good 52 of the banding machine of FIG. 5*a*.

Here it can be seen that the conveying surface 35 is interrupted in the area of the band guide 50 to allow the band 22 to wrap around the packaged good 52.

Figure 6A:
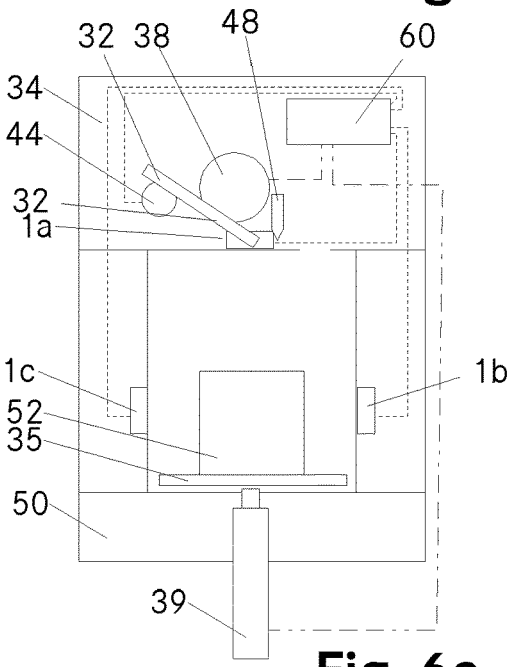
FIG. 6*a* a view in the conveying direction of the packaged good of the curved band guide of a banding machine and packaged good fed on a conveyor belt, the band drive roller and the welding and cutting unit being arranged above the conveyor belt.

FIG. 6*a* shows a view of the curved band guide 50 of a banding machine in the conveying direction of the packaged good 52. A fed packaged good 52 is on a conveyor belt. In FIG. 6*a*, the band drive roller 38 as well as the welding and cutting unit 48 and the insertion opening 37 are arranged above the conveying surface 35. The conveying surface 35 is mounted on height-adjustable legs 39.

In principle, the banding process is analogous to that described with regard to FIGS. 1 and 5*a*. In contrast to these methods, however, the vertically measuring distance sensor 1*a* now determines the distance to the packaged good 52 while the conveying surface 35 is in its lowest position, its home position, and the controller 60 forwards this information to the legs 39, which then lift the conveying surface 35 with the packaged good 52 until it comes into contact with the side wall of the machine housing 34 in which the insertion opening 37 is located. This measured distance, which has now been compensated by the legs 39, is one of the distances that is included in the determination of the desired value. The other two distances are determined by two distance sensors 1*c* and 1*b* measuring in the horizontal. The controller stores the distance between the distance sensors 1*c* and 1*b* as well as the distance between the distance sensor 1*a* and the conveying surface 35 in its home position. Also stored are the overlap length and the buffer length. From these values, the controller 60 determines the desired value.

Figure 6B:
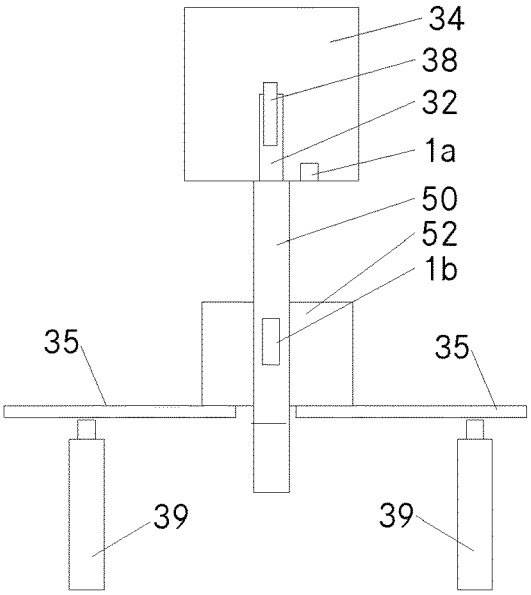
FIG. 6*b* a view perpendicular to the conveying direction of the packaged good of the banding machine of FIG. 6*a;*

FIG. 6*b* shows a view perpendicular to the conveying direction of the packaged good 52 of the banding machine of FIG. 6*a*.

Here it can be seen that the conveying surface 35 is interrupted in the area of the band guide 50 to allow the band 22 to wrap around the packaged good 52. It can also be seen that the distance sensor 1*a* is arranged next to the insertion opening 37 to provide space for the band channel 32, the welding and cutting unit 48 and the band 22.

Figure 7A:
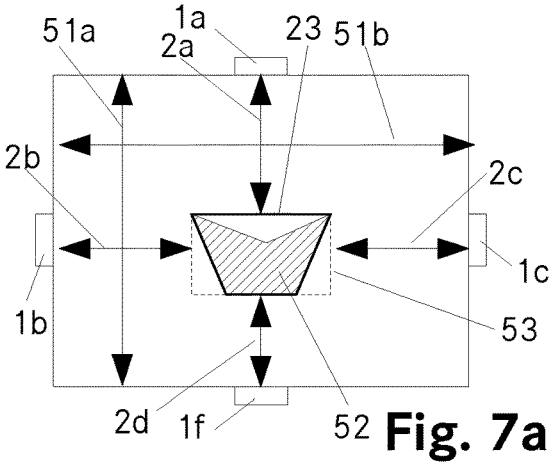
FIG. 7*a* an illustration of the distances as well as the banderole around a packaged good with a non-rectangular cross-section as well as the estimated wrapping circumference for this packaged good when using simple distance sensors.

FIG. 7*a* illustrates the various distances 2*a*-2*d*, 51*a* and *b* and the banderole 23 around a packaged good 52 with a non-rectangular cross-section and the estimated wrapping circumference 53 for this packaged good 52.

The packaged good 52 is a tray that is indented in the center of its lid, that is, locally concave. The banderole 23 is not intended to follow this concave section, but spans it. On the other hand, the banderole 23 rests against the convex surfaces of the packaged good 52. The banderole 23 thus appears in trapezoidal form in its cross-section.

The circumference of the trapezoid is now estimated by the circumference of the enveloping rectangle. This is the estimated wrapping circumference 53. The wrapping rectangle is indicated by a dashed line.

The wrapping circumference 53 is determined by positioning distance sensors 1*a-c,f* or guide elements at known distances from each other and in such a way that measurements are taken in a first and in a second dimension perpendicular to each other. In the view shown, the edges of the zero planes of all distance sensors 1*a-c, f* are viewed. The zero planes, drawn with solid lines and only in the area between their intersecting lines, complement each other to form a rectangle. The band guide plane is the plane the viewer of FIG. 7*a* is looking at. The distances of the distance sensors 1*a-c, f* from each other are marked 51*a* and 51*b*. This is the extension of the measuring range. It would also be possible to replace one of the opposing distance sensors with a guide element. In this case, however, the packaged good 52 should rest against the guide element.

The distance sensors 1*a-c, f* then each determine the smallest distance that the packaged good 52 has from their zero plane. These are the distances 2*a*-2*d*.

The zero plane of a distance sensor 1*a-f* is the plane from which the distance is determined and to which the distance sensor 1*a-f* would determine a distance of 0 at least at one point. The normal of the zero plane is the measuring direction of the distance sensor 1*a-f* or the symmetry axis of the field of view of the distance sensor 1*a-f*.

Figure 7B:
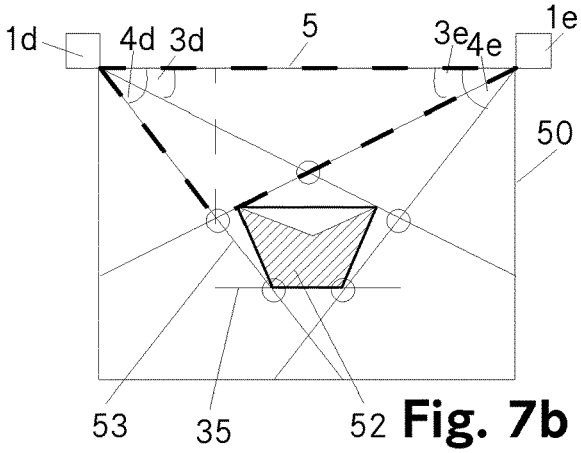
FIG. 7*b* An illustration of the estimation of the wrapping circumference from the determination of limit observation angles.

FIG. 7*b* illustrates the estimation of the wrapping circumference 53 when the distance sensors 1*d* and 1*e* can determine the limit observation angles 3*e*, 3*d*, 4*e*, 4*d* and the distance between the distance sensors 1*d*, 1*e* is known.

The distance sensors 1*d* and 1*e* are mounted on the band guide 50 at a known distance from each other. The packaged good 52 each obscures a portion of the band guide 50 that the distance sensor 1*d* or 1*e* would detect in the absence of the packaged good 52. The angles at which the limits of the packaged good 52 appear to the respective distance sensor 1*d*, 1*e* are the limit observation angles 3*e*, 3*d*, 4*e*, 4*d*.

In the present example, the connecting line of the two distance sensors 1*d*, 1*e* serves as reference 5 from which the angles are measured. Here, both distance sensors 1*d, e* use the same reference 5, but it is also possible that each distance sensor 1*d, e* uses its own reference 5. Based on this reference 5, there is respectively a small limit observation angle 3*d, e* and a large limit observation angle 4*d,e*.

In the example shown, the packaged good 52 is also guided on a conveying surface 35. The position of the conveying surface 35 with respect to the distance sensors 1*d*, 1*e* is also known.

In order to estimate the wrapping circumference 53, the first two intersections of the following straight lines counted from the distance sensors 1*d*, 1*e* are used. The straight lines should all lie in the band guide plane:

- A straight line passing through the distance sensor 1*d*, i.e., the first observation point, which includes the small limit observation angle 3*d* of the distance sensor 1*d* with the reference 5 of the distance sensor 1*d*.
- A straight line passing through the distance sensor 1*d*, i.e., the first observation point, which includes the large limit observation angle 4*d* of the distance sensor 1*d* with the reference 5 of the distance sensor 1*d*.
- A straight line passing through the distance sensor 1*e*, i.e., the second observation point, which includes the small limit observation angle 3*e* of the distance sensor 1*e* with the reference 5 of the distance sensor 1*e*.
- A straight line passing through the distance sensor 1*e*, i.e., the second observation point, which includes the large limit observation angle 4*e* of the distance sensor 1*e* with the reference 5 of the first distance sensor 1*e*.
- A straight line on the conveying surface 35

The straight lines emanating from one distance sensor 1*d*, 1*e* obviously intersect only at the observation point of the distance sensor 1*d*, 1*e* from which they emanate. Since both distance sensors 1*d*, 1*e* observe the same packaged good 52 but do not use the same observation location, both straight lines emanating from one distance sensor 1*d*, 1*e* intersect both straight lines emanating from the other distance sensor 1*e*, 1*d*. Except in the rather unusual case that one of the distance sensors 1*e*, 1*d*, is placed exactly at the level of the conveying surface 35, the straight line of the conveying surface 35 is not parallel to any of the other straight lines and intersects them accordingly. There are thus a total of 8 intersection points. Of these, however, only the first two intersection points are used in the further evaluation. In FIG. 4*b*, these intersection points, which are to be used for estimating the wrapping circumference 53, are marked with circles.

The position of the intersection points in space can be determined mathematically: Intersection points of straight lines emanating from distance sensors 1*d, e* are comer points of triangles of which one side and the angles adjacent to it are known. Comer points of intersection of a straight line emanating from a distance sensor 1*d, e* and the conveying surface 35 are comer points of right-angled triangles, of which the length of a cathetus and another angle are known: The cathetus is just the height of the corresponding distance sensor 1*d, e* above the conveying surface 35. The wrapping circumference 53 is then estimated to be the circumference of the polygon which results from the considered intersections.

In summary, instead of the difference length, the return length can also be used for comparison with the desired value, although the desired value must be suitably determined. In addition, the target band tension can be set in other ways and can also be measured and monitored directly. The banding machine may be equipped with other sensors, such as detection sensors that can detect the packaged good type. The first and second dimensions can be the horizontal and the vertical.

Since the devices and methods described in detail above are examples of embodiments, they can be modified to a wide extent by the skilled person in the usual manner without departing from the scope of the invention. In particular, the mechanical arrangements and the proportions of the individual elements with respect to each other are merely exemplary. Some preferred embodiments of the apparatus according to the invention have been disclosed above. The invention is not limited to the solutions explained above, but the innovative solutions can be applied in different ways within the limits set out by the claims.

The invention claimed is:

1. A banding machine, comprising a band guide, a band drive, a rotary encoder and a controller, wherein:

a) at least one distance sensor is arranged on the band guide, b) the at least one distance sensor is configured to estimate a wrapping circumference, c) the band drive is configured to retract a band, d) the rotary encoder is configured to i) detect a retracted length of the band or ii) detect a difference in length, which is the difference between an inserted length and the retracted length of the band, e) the controller is configured to determine a desired value taking into account at least one measured value of the at least one distance sensor, and f) the controller is configured to control the band drive such that, during retraction, the band is initially retracted at a first retraction speed and, as soon as i) the retracted length or ii) the difference in length corresponds to the desired value, the band is retracted at a second retraction speed, which is lower than the first retraction speed.

2. The banding machine according to claim 1, wherein the at least one distance sensor comprises at least two distance sensors, one of which is configured to determine a first distance to a packaged good in a first dimension and one of which is configured to determine a second distance to the packaged good in a second dimension.

3. The banding machine according to claim 2, wherein i) the desired value is equal to twice the sum of the first and second distances to the packaged good minus a buffer length, when the desired value is compared with the retracted length; and ii) the desired value is equal to the sum of twice the first and second distances of the distance sensors or of guide elements from each other and an overlap length minus twice the sum of the first and second distances to the packaged good and minus a buffer length, when the desired value is compared with the difference in length.

4. The banding machine according to claim 1, comprising at least two distance sensors configured to realize a first observation point and a second observation point at a known distance from each other, wherein one of said distance sensors is configured to determine a small and a large limit observation angle from a first observation point and the other distance sensor is configured to determine a small and a large limit observation angle from a second observation point.

5. The banding machine according to claim 4, wherein i) the estimated wrapping circumference is estimated to be a perimeter of a polygon whose corners are a first intersection and a second intersection, counted from the respective observation point, of the following straight lines lying in a band guide plane and lying outside the observation points:

(1) a straight line passing through the first observation point and including the small limit observation angle of the first observation point, (2) a straight line passing through the first observation point and including the large limit observation angle of the first observation point, (3) a straight line passing through the second observation point and including the small limit observation angle of the second observation point, (4) a straight line passing through the second observation point and including the large limit observation angle of the second observation point, (5) a straight line on a conveying surface;

ii) the desired value is equal to the circumference of the band guide minus the sum of the estimated wrapping circumference and a buffer length, when the desired value is compared to the retracted length; and iii) the desired value is equal to the sum of the estimated wrapping circumference, an overlap length and a buffer length when the desired value is compared to the difference in length.

6. The banding machine according to claim 3, wherein the buffer length is 10 to 20 cm.

7. The banding machine according to claim 1, comprising at least one input interface via which a target band tension is set and at least one recognition sensor configured to recognize a packaged good type.

8. The banding machine according to claim 7, wherein the at least one distance sensor comprises at least two distance sensors, one of which is configured to determine a first distance to a packaged good in a first dimension and one of which is configured to determine a second distance to the packaged good in a second dimension, wherein the at least one recognition sensor is configured to use at least one of the at least two distance sensors and configured to recognize the packaged good type on the basis of at least one of the dimensions of a packaged good, on the basis of reflective properties and a packaged good appearance.

9. The banding machine according to claim 7, wherein the second retraction speed is selected in dependence on the target band tension.

10. The banding machine according to claim 1, wherein the at least one distance sensors is an optical sensors.

11. The banding machine according to claim 1, wherein the band is configured to be pushed through an insertion opening into the band guide;

the insertion opening is located below a conveying surface;

the at least one distance sensor comprising two distance sensors arranged on the band guide substantially opposite each other and configured to determine a horizontal distance to a packaged good from opposite directions; and the at least one distance sensor further comprising a third distance sensor arranged above a conveying surface and configured to determine a vertical distance to the packaged good.

12. The banding machine according to claim 1, wherein:

the band is configured to be pushed through an insertion opening into the band guide;

the insertion opening is arranged next to a conveying surface;

a first distance sensor is located on the band guide opposite the insertion opening and configured to determine a horizontal distance to a packaged good; and a second distance sensor is located on the band guide above the conveying surface and is configured to determine a vertical distance to the packaged good.

13. The banding machine according to claim 1, wherein the at least one distance sensor is configured to estimate the wrapping circumference with the aid of the at least one measured value of the at least one distance sensor such that a distance from a packaged good lying within the band guide is determined from the measured value.

14. The banding machine according to claim 5, wherein in addition to the straight lines, a straight line on the conveying surface is considered as the straight line lying in the band guide plane and lying outside the observation points.

15. The banding machine according to claim 7, wherein:

the sensor is configured to recognize the packaged good type by an identification code on the packaged good, and the banding machine comprises a memory with a database in which a target band tension is assigned to the packaged good type.

16. The banding machine according to claim 10, wherein the distance sensor is are configured to use laser triangulation, time-of-flight or interferometry as a measuring principle.

17. A method for banding, comprising the steps of:

determining at least one of distances or limit observation angles to a packaged good lying within a band guide, or estimating a wrapping circumference with the aid of at least one measured value of at least one distance sensor arranged on the band guide;

determining a desired value taking into account at least one of the determined distances and the limit observation angles or the estimated wrapping circumference;

retracting the band at a first retraction speed;

detecting a retracted length of the band or detecting a difference in length, that is, a difference between an inserted length and the retracted lengths of the band; and from the time at which the retracted length of the band or the difference in length corresponds to the desired value, retracting the band at a second retraction speed which is smaller than the first retraction speed.

18. The method according to claim 17, wherein the same band drive accelerates and brakes the band during insertion and during retraction.

19. The method according to claim 17, further comprising the step of terminating the retraction and connecting the band to itself once a target band tension is reached.

20. The method according to claim 17, further comprising the step of inserting a band into the band guide.

* * * * *